United States Patent [19]

Jeschke et al.

[11] 4,188,882

[45] Feb. 19, 1980

[54] DAMPENING UNIT FOR OFFSET PRINTING MACHINES

[75] Inventors: Willi Jeschke, Heidelberg; Paul Schilling, Neckargemünd; Anton Breunig, Neckargemünd-Dilsberg, all of Fed. Rep. of Germany

[73] Assignee: Heidelberger Druckmaschinen Aktiengesellschaft, Heidelberg, Fed. Rep. of Germany

[21] Appl. No.: 897,742

[22] Filed: Apr. 17, 1978

[30] Foreign Application Priority Data

Apr. 16, 1977 [DE] Fed. Rep. of Germany ..... 2716929

[51] Int. Cl.[2] ..... B41F 7/26; B41F 7/30; B41F 7/32; B41L 25/06

[52] U.S. Cl. ..... 101/148; 101/366

[58] Field of Search ..... 101/147, 148, 366, 116, 101/119, 120, 126, 127.1, 128.1, 375, 376, 350, 363; 261/92; 118/259, 301, 325; 239/214.25, 218, 220, 222, 222.11

[56] References Cited

U.S. PATENT DOCUMENTS

| | | | |
|---|---|---|---|
| 2,689,523 | 9/1954 | Koch | 101/147 |
| 3,143,065 | 8/1964 | Warczak | 101/147 |
| 3,411,718 | 11/1968 | Wagner | 101/147 X |
| 4,044,673 | 8/1977 | Junghans | 101/148 |

FOREIGN PATENT DOCUMENTS

| | | | |
|---|---|---|---|
| 175956 | 2/1953 | Austria | 101/147 |
| 931228 | 7/1955 | Fed. Rep. of Germany | 101/147 |
| 1055011 | 4/1959 | Fed. Rep. of Germany | 101/147 |
| 297861 | 4/1954 | Switzerland | 101/148 |
| 710875 | 6/1954 | United Kingdom | 101/147 |

*Primary Examiner*—J. Reed Fisher
*Attorney, Agent, or Firm*—Herbert L. Lerner

[57] ABSTRACT

In a dampening unit for offset printing machines having a dampening-medium tank, a rotating screen cylinder formed of a perforated support member covered by a blanket for conveying dampening medium supplied thereto from the tank, and a blow tube located adjacent the blanket and formed with nozzle openings for spraying the dampening medium by means of blowing air from the blanket onto a dampening unit roller, the improvement therein which includes means for freely rotatingly guiding the screen cylinder, and a driven dampening-medium conveying roller immersed in the dampening medium received in the tank and being in frictional engagement with the screen cylinder so as to feed the dampening medium from the tank to the blanket.

12 Claims, 4 Drawing Figures

DAMPENING UNIT FOR OFFSET PRINTING MACHINES

The invention relates to a dampening unit for offset printing machines having a dampening-medium tank, a rotating screen cylinder formed of a perforated support member covered by a blanket for conveying dampening medium supplied thereto from the tank, and a blow tube located adjacent the blanket and formed within the dampening medium by means of blowing air onto a dampening-unit roller or rollers for, in turn, transferring the dampening medium to the offset plate of the machine.

Dampening units have become known heretofore wherein, as explained more fully hereinbelow, the dampening medium is transferred from a supply tank onto the offset plate by means of transfer cylinders which are in lasting or intermittent mutual contact. So-called contactless dampening units have also become known, wherein the dampening medium, on the transport path thereof from the supply tank to the offset plate, is transferred for a given distance in finely divided form by the air either directly onto the offset plate or onto a so-called spray-on cylinder. The transport or conveyance of the dampening medium by the air occurs in this case by spraying with the aid of a blowing air jet.

These so-called contactless dampening units have the advantage that transport or conveyance is possible only in one direction, namely from the dampening supply tank in direction towards the printing plate. The reverse direction of transport or conveyance is excluded, in contradistinction to the dampening unit with mutually contacting cylinders. Due to this fact, it is impossible for any printing ink to pass from the offset plate into the dampening supply tank, so that the dampening medium does not become contaiminated with ink.

Whereas, in the dampening units with transfer by contact, quantity regulation or control is reflected in a more-or-less thicker or thinner thickness of film on the transfer cylinders, in the case of the contactless transfer paths, the dampening medium is in the form of drops. The problem of quanity regulation is aggravated by the subsidiary problems of effecting uniform distribution of the droplets, on the one hand, and obtaining desirable constant optimal size of the droplets, among themselves, on the other hand.

A so-called nozzle or jet dampening unit has become known from German Patent DT-PS No. 880 309, wherein a rotating screen cylinder is used, the lowest part of which dips into the supply tank and absorbs liquid within the screen mesh thereof, the liquid being then blown out of the screen from the inside of the screen cylinder by means of compressed air and sprayed onto the spray-on cylinder. Since the screens which are formed of wire mesh or other fine-meshed fabric exhibit little or no stability, they are mounted on perforated hollow cylinders of solid metal. Quantity regulation is effected by modifying the speed of rotation of the driven screen cylinder.

With this heretofore known construction, the liquid level in the supply tank must be maintained exactly in order that only the fine-meshed screen comes into contact with the liquid, otherwise liquid would also be transported or conveyed in uncontrollable quantity into the perforations of the support member, and blown out as well. The hereinaforementioned condition of accurate quantity regulation and fine distribution of the quantity of water that is taken up is thus not fulfilled, as has been clearly found by various experiments.

Another fact regarding this known construction is that the dismantling of the screen cylinder, which is mounted in rolling-contact bearings or slide bearings and is drivingly connected to the control motor or control transmission for the purpose of exchanging or cleaning the fine-mesh screen, is complicated and time-consuming.

In another heretofore known nozzle or jet dampening unit described in German Pat. DT-PS No. 880,308, the screen cylinder dips so deeply into the dampening medium that the dampening medium level comes to lie within the cylinder. By this means, considerably more dampening medium is transported to the blowing nozzle than is required. In order to obviate this, in this conventional construction, an additional blow tube is provided outside the cylinder, which blows off the surplus or excess quantity of water.

This additional outlay is further increased by shutters or adjusting screws by means of which the blowing air must be regulated or controlled. The squeeze-off cylinder provided therein represents an additional expense, and exact quantity regulation and fine distribution of the quantity of water taken up is not impossible therewith.

Another heretofore-known construction from the German Published Prosecuted Application DT-AS No. 25 04 778 employs a dipping or immersion cylinder dipping into the dampening medium, from which the dampening medium is blown off by means of a blowing air jet. In this case, the dipping cylinder is blanketed with a tubular layer of material. In this heretofore-known construction, that the quantity of water transported or conveyed greatly exceeds requirements, a relatively strong air blast is required in order to blow off the dampening medium and no possibility of regulating or controlling the quantity of dampening medium to be transferred is provided. It is also impossible thereby to obtain a fine distribution of the dampening medium, especially in a zonewise manner.

It is accordingly an object of the invention to provide a contactless air-flow dampening unit of the hereinaforementioned general type which avoids the disadvantages of heretofore-known devices and which ensures a finely meterable distribution of the dampening medium by simple means and an optimal and constant size of the dampening-medium droplets.

With the foregoing and other objects in view, there is provided, in accordance with the invention, in a dampening unit for offset printing machines having a dampening-medium tank, a rotating screen cylinder formed of a perforated support member covered by a blanket for conveying dampening medium supplied thereto from the tank, and a blow tube located adjacent the blanket and formed with nozzle openings for spraying the dampening medium by means of blowing air from the blanket onto a dampening-unit roller, the improvement therein which comprises means for freely rotatingly guiding the screeen cylinder, and a driven dampening-medium conveying roller immersed in the dampening medium received in the tank and being in frictional engagement with the screen cylinder so as to feed the dampening medium from the tank to the blanket. This construction accomplishes the aim of the invention in a simple manner, and the indirect feed of the dampening medium by means of the conveying cylinder or roller provides an ever uniform film of water on the screen cylinder. Furthermore, the conveying cylinder or roller drivable at variable speed permits ready metering of the dampening medium on the screen cylinder which co-rotates at equal speed. Expensive height regulation of the dampening medium level is also eliminated with the invention. It is, moreover, possible to strip off the dampening medium zonewise from the conveying cylinder.

In accordance with another feature of the invention, the guide means define three mutually spaced, fixed lines disposed at the peripheral surface of the screen cylinder and along which the screen cylinder is guided in spatial position thereof so as to have only a single degree of freedom, namely rotation about the axis thereof. The position of the screen cylinder is thus axially secured. The screen cylinder rests upon the dipping or conveying cylinder or roller along an external line of contact, taking the gravity component into consideration.

In accordance with a further feature of the invention, the guiding means comprise a blowing tube, and the screen cylinder frictionally engaging the dampening-medium conveying roller is stuck on the blowing tube. This permits a simple and easy dismantling or exchanging of the screen cylinder.

In accordance with an additional feature of the invention, the blowing tube is disposed eccentrically to the rotary axis of the screen cylinder and wherein one of the fixed lines is located in the wall surface of the blowing tube in vicinity of the nozzle openings formed therein, and another of the fixed lines is located in at least one spacer member extending from the wall surface of the blowing tube at the opposite side thereof from the one of the fixed lines. With the direct contact of the nozzle openings at the screen cylinder, a uniform and accurate blowing off of the dampening medium is obtained at minimal pressure of the blowing air and at minimal quantity of air.

In order to achieve simple zonewise quantity regulation of the dampening medium without complicated control of the blowing air and without adjustable shutters, and in order to regulate the overall quantity of the dampening medium, in accordance with an added feature of the invention, there are provided means for stripping dampening medium from the conveying roller, the stripping means medium being disposed along the conveying roller upstream of a line of frictional engagement of the conveying roller with the screen cylinder in direction of rotation of the conveying roller and being zonewise adjustable with respect to the peripheral surface of the conveying roller, and variable-speed drive means for the conveying roller.

In accordance with an added feature of the invention, the dampening unit includes an air supply tube for the blowing air having a smaller diameter than and disposed within the blow tube, the air supply tube being formed with openings located offset in peripheral direction from the nozzle openings formed in the blow tube whereby air is supplied to the blow tube through the openings formed in the air supply tube, and the blow tube serves as an air storage chamber. Absolutely uniform air distribution for low pressure of the blowing air at the blowing nozzle openings along the entire length of the screen cylinder is obtained by the construction of the blow tube as an air accumulator and by providing the special type of air supply means.

In accordance with yet another feature of the invention, the nozzle openings formed in the blow tube are bores formed in the wall thereof, the bores having a diameter smaller than the thickness of the wall of the blow tube.

In accordance with yet an additional feature of the invention, the dampening unit includes means for regulating the intensity of the blowing air.

In accordance with yet a further feature of the invention, the one spacer member is radially disposed at one end of the blow tube, and another spacer member is radially disposed at the other end of the blow tube. In accordance with still another feature of the invention, at least a surface portion of the conveying roller is formed of hydrophilic material.

In accordance with a further feature of the invention, the conveying roller is covered with an hydrophilic fabric material.

In accordance with a concomitant feature of the invention, there is provided in a dampening unit for offset printing machines having a dampening-medium tank, a rotating screen cylinder formed of a perforated support member covered by a blanket for conveying dampening medium supplied thereto from the tank, and a blow tube located adjacent the blanket and formed with nozzle openings for spraying the dampening medium by means of blowing air from the blanket onto a dampening-unit roller, the improvement therein which comprises a dampening-medium conveying roller immersed in the dampening medium received in the tank and being in frictional engagement with the screen cylinder so as to feed the dampening medium from the tank to the blanket, the tank forming part of a container surrounding the screen cylinder and the conveying roller and formed with a substantially horizontal opening extending along the length thereof for providing access by a jet of the dampening medium blown by the air to the dampening-unit roller, shutter means defining upper and lower limits of the substantially horizontal opening, the shutter means defining the upper limit being spaced slightly from the screen cylinder, and the shutter means defining the lower limit being spaced slightly from the dampening-unit roller, the latter being disposed within the substantially horizontal opening so as to leave a partial opening at the top thereof for discharge of air from the container.

In this way, optimal compartmentation and limitation of the dampening-medium jet without having the dripping dampening medium strike the cylinders or rollers of the dampening unit, is achieved.

Any unintentional evaporation of the dampening medium is prevented by this construction. Moreover, drops which form on the shutters or walls cannot be entrained by the dampening-medium jet as they fall and strike the cylinder or roller of the dampening unit. An unintentional increase in the supply of water is thereby prevented. Due to the space provided, air discharged in the upper region above the cylinder or roller of the dampening unit, dampening-medium droplets entrained in the air-flow can settle on the cylinder or roller, so that possible discharge of dampening medium into the room or ambient air is thereby prevented. Other features which are considered as characteristic for the invention are set forth in the appended claims.

Although the invention is illustrated and described herein as embodied in dampening unit for offset printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
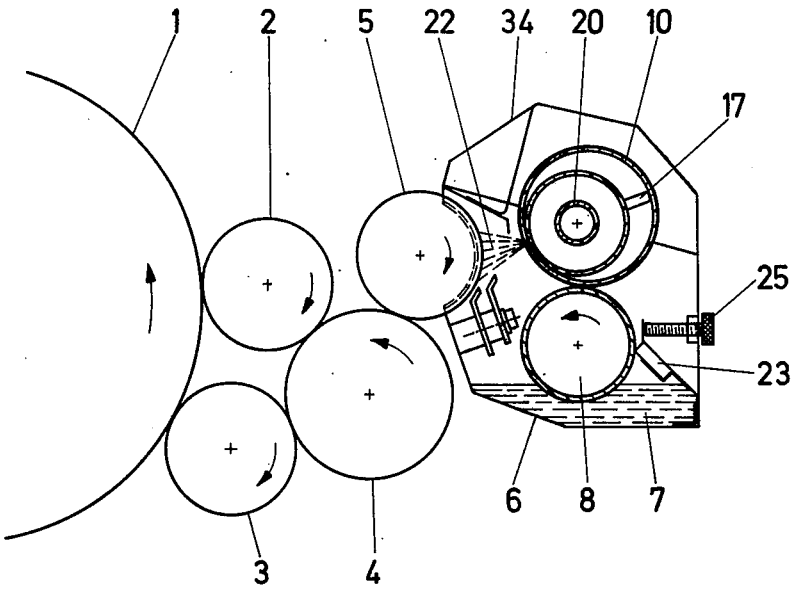
FIG. 1 is a diagrammatic, partly cross-sectional view of a dampening unit according to the invention.

Referring now to the figures of the drawing and first, particularly, to FIG. 1 thereof, there is shown a plate cylinder 1 which received dampening medium in a conventional manner from two applicator cylinders 2 and 3 to which, in turn, cylinders 4 and 5 of a dampening unit feed the dampening medium. The cylinder 4 may have the construction of a friction cylinder.

A fountain or tank 6 contains dampening medium 7, in which a feeder or ductor cylinder 8 is immersed. The ductor cylinder 8 is formed of hydrophilic material at the surface thereof and is constructed, for example, as a chromium-plated steel cylinder. It may also be covered with a blanket of hydrophilic web or fabric material 9 (FIG. 2), for example, of textiles, prepared synthetic or plastic material, porous rubber or the like. The ductor cylinder 8 is mounted in lateral walls of the tank 6 and is set into rotation in direction of the associated arrow by a non-illustrated conventional drive. The speed of rotation of the cylinder 8 may be modified by means of an infinitely variable transmission or a variable-speed motor, depending upon the need for dampening medium by the respective printing operation or press speed.

Figure 4:
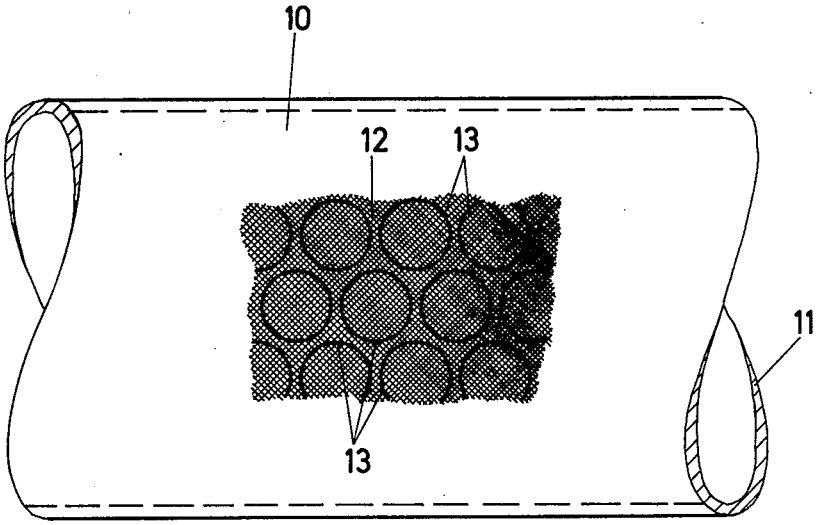
FIG. 4 is a fragmentary enlarged view of the screen cylinder envelope surface.

A film of dampening medium which becomes formed on the hydrophilic surface of the ductor cylinder 8 is transferred onto a screen cylinder 10 disposed above the ductor cylinder 8. As shown in FIG. 4, the screen cylinder 10 is formed of a support member 11 constructed as a solid tube and covered, in turn, by a dampening-medium carrying blanket 12 made of a fine-mesh fabric covering larger perforations 13 that are distributed in close succession over the outer surface of the support member 11. The screen cylinder 10 is guide freely rotationally and is in frictional contact with the blanket 12 on the ductor cylinder 8. When the latter rotates, the screen cylinder 10 receives the dampening medium fed by the ductor or ink-conveyor cylinder 8.

Figure 2:
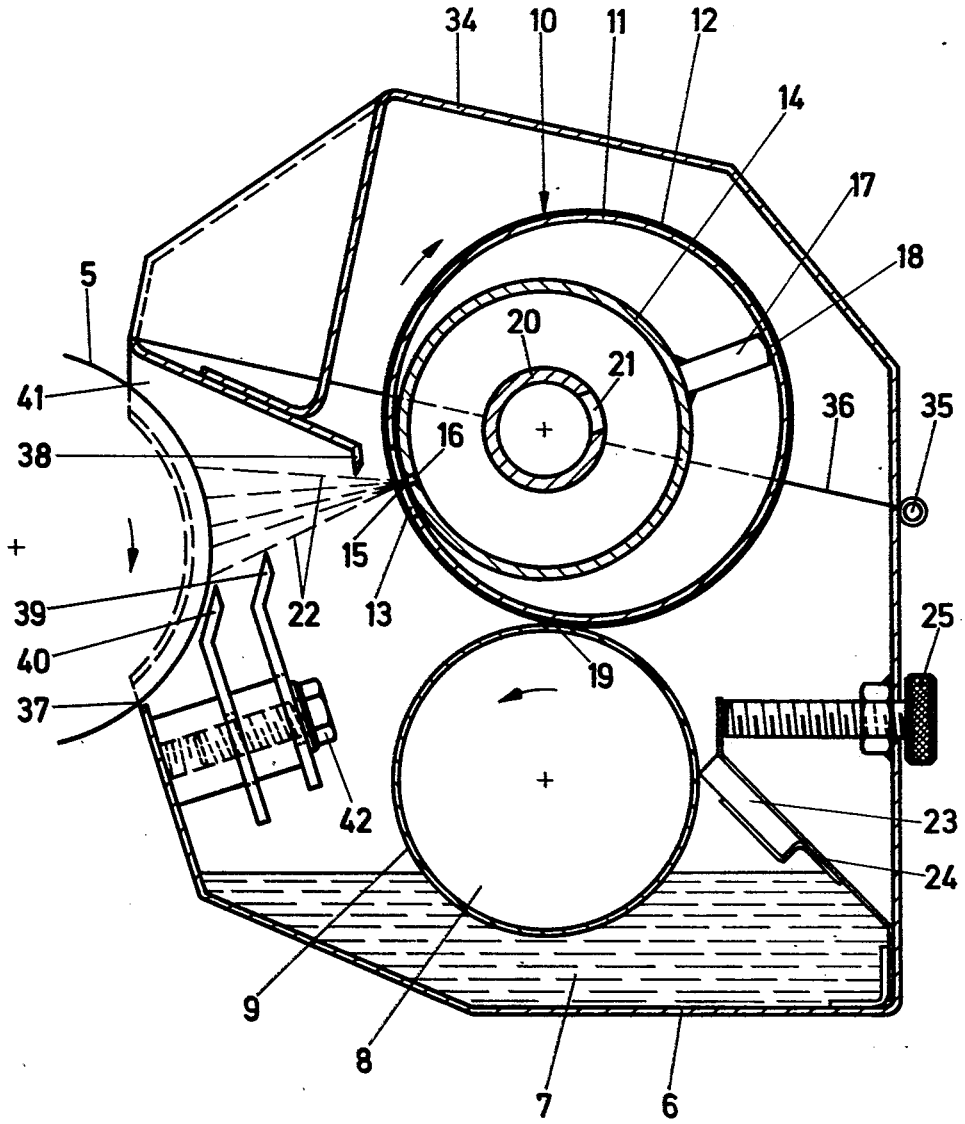
FIG. 2 is a fragmentary enlarged view of FIG. 1 showing more clearly a screen cylinder and a feeder cylinder and a tank surrounding them in accordance with the invention.

With reference to FIG. 2, it is apparent that the screen cylinder 10 disposed on the cylinder 8 is stuck on a blow tube 14 which guides the screen cylinder 10. The blow tube 14 is disposed eccentrically to the axis of rotation of the screen cylinder 10, so that the rotating screen cylinder 10, at one side thereof, engages a surface line 15 of the blow tube 14 in vicinity of jet orifices 16 formed therein and is guided on the opposite side thereof by spacer members 17. The screen cylinder 10 is thus guided at the surface line 15 and the contact line 18 so that it rests with dead weight upon the ductor cylinder 8 at a contact line 19. Due to these three fixed engagement lines 15, 18 and 19, which extend perpendicularly to the plane of the drawing of FIG. 2, the screen cylinder 10 is confined within the spatial or physical position thereof so that it retains only a single degree of freedom, namely that of rotation about its own axis.

An air supply tube 20 is disposed concentrically or coaxially to the blow tube 14, which is integral with the frame, and is, furthermore, located within the tube 14. The air supply tube 20 supplied blowing air through orifices 21 to the blow tube 14 which serves as an air accumulator. The blow tube 14 operating as an air accumulator has a greater diameter, for example, three times the diameter of the air supply tube 20, in order to pacify or stabilize the blowing air supply. The orifices 21 formed in the air supply tube 20 are disposed in a staggered or offset distribution, for example, offset by 180°, in peripheral direction with respect to the jet orifices 16 formed in the blow tube 14. Obviously, the blow tube 14 may also have a different cross-sectional shape, such as oval, for example, so that the surface line 15 and the contact line 18 both lie on the tube 14 per se, and no spacer member 17 is required.

The jet orifices 16 formed in the wall of the blow tube 14 are formed as bores having a small diameter relative to the wall thickness of the blow tube 14, a diameter of approximately 1 mm being advantageous. The air fed uniformly through the orifices 21 into the space between the blast tube 14 and the air supply tube 20 can be pacified or stabilized therein, and then flows at a pressure of approx. 0.3 to 0.5 atmospheres excess pressure through the jet orifices 16, which have a relatively small aperture angle. The air then flows in jet direction through the immediately adjacent perforations 13 of the support member 11 and the blanket 12 covering the latter onto the cylinder or roller 5 of the dampening unit which is spaced from the blanketcovered screen cylinder 10. The support member 11 of the screen cylinder 10 in this distribution of the dampening medium over or across the dampening-medium jet 22 is assured.

In addition to the variable-speed drive of the ductor cylinder 8, strippers 23 having a zonewise adjustability are additionally associated with the ductor cylinder 8. The strippers 23 are disposed along the length of the ductor cylinder 8 in front of the contact line 19 of the bearing location of the screen cylinder 10 i.e. upstream therefrom in the direction of ink conveyance or rotation of the ductor cylinder 8 or strip inserted loosely into a resilient support 24 fixed to the tank 6. The stripper 23 is adjustable zonewise against the wall surface of the ductor cylinder 8 by a number of set screws 25 disposed on a line perpendicular to the plane of the drawing of FIG. 2, only one of which is visible. The set screws 25 are braced against the wall of the tank 6. The shortest supply path of the dampening medium to the blow device, as considered in direction of rotation of the ductor cylinder 8 or the screen cylinder 10, is thus regulatable directly through the strippers 23, so that zonewise regulation of the quantity of dampening medium is provided in addition to the drive regulation of the ductor cylinder 8. A stripper with an interrupted stripping edge may also be inserted instead of the illustrated stripper which has a continuous stripping edge.

Figure 3:
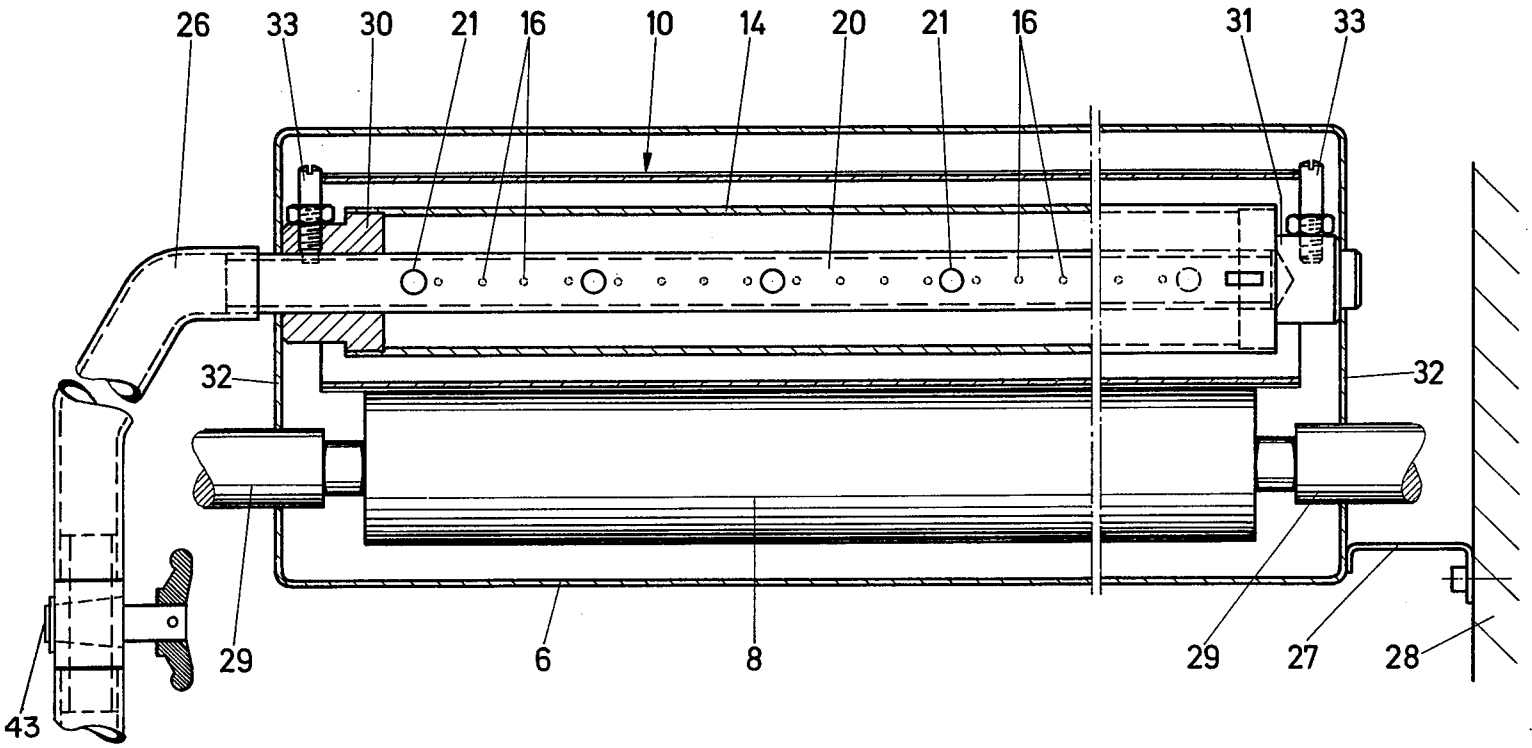
FIG. 3 is a longitudinal sectional view of the screen cylinder, transport cylinder and surrounding tank assembly of FIG. 2.

As shown in FIG. 3, blowing air is supplied through a tube 26 which is stuck onto the air supply tube 20. The intensity or volume of air supply is regulatable in intensity by a conventional valve 43, so that the quantity of dampening medium supplied to the cylinder 5 is likewise variable thereby. This regulation or control can be provided in place of the rotary speed regulation of the ductor cylinder 8, if desired.

As is further apparent from FIG. 3, the tank 6 is fixed to the side frames 28 on both sides of the printing machine by suitable stays or bracing members 27. The ductor cylinder 8 is mounted by journals 29 in the tank 6. The blow tube 14 is provided at both ends thereof with a respective closure cover 30 and 31 between which the air supply tube 20 is mounted. The air supply tube 20 and the closure cover 30 and 31 are inserted into corresponding bores formed in the lateral walls 32 of the tank 6 and are held in place against rotation by a dampening-unit cover 34 (FIG. 2). Easily unscrewable limit pins 33 are provided in the closure 30 and 31 for axial guidance of the screen cylinder 10.

The screen cylinder 10 and the ductor cylinder 8 are surrounded by the tank 6 which is provided with the cover 34 in the upper region thereof. The cover 34 is openable swingably about a hinge 35 (FIG. 2). The parting or junction line 36 of the cover 34 extends through the bearing bore of the air supply tube 20 and through the closure cover 31. The tank 6 is formed along the length thereof with an opening 37 for the dampening medium jet 22, which is bounded on both sides thereof by shutters or diaphragms 38, 39 and 40. The top shutter 38, as viewed in FIG. 2, is spaced a short distance from the screen cylinder 10, whereas the lower shutters 39 and 40 are located at a short distance from the next cylinder 5 of the dampening unit. A space 41 for discharge of air is also provided above the cylinder 5, as viewed in FIG. 2. The lower shutters 39 and 40 are fastened firmly to the tank 6 by means of screws 42 and extend, like the top shutter 38, along the length of the cylinder 5 i.e. into the plane of the drawing of FIG. 2. The top shutter 38 serves to limit the dampening madium jet 22 upwardly, and the reason for locating it in proximity to the screen cylinder 10 is so that a dripping water drop would not be blown up onto the cylinder 5 by the air-stream, but would therefore, rather drip back into the dampening medium 7. The lower shutters 39 and 40 serve to limit the dampening madium jet 22 in downward direction and, with the double disposition thereof, form a sort of labyrinth seal which prevents dampening-medium droplets from being entrained by the cylinder 5 during the rotation thereof and from discharging in an uncontrolled manner from the tank 6. Dampening-medium droplets, which are entrained from the space 41 by the blowing air, fall back onto the cylinder 5 immediately outside the tank 6 and can thus, likewise, not escape uncontrollably from the dampening unit. Whereas the ductor cylinder 8 requires virtually no maintance, the need does exist to clean and/or replace the blanket 12 of the screen cylinder 10 when it is soiled or contaminated by deposits from the dampening medium. For this purpose, the cover is swung open, the tube 26 is withdrawn from the air supply tube 20 and the screen cylinder 10, including the blow tube 14 and air supply tube 20, is removed from the tank 6. After removing a limit pin 33, the support member 11 with the blanket 12 can be withdrawn from the blow tube 14. The stocking-shaped blanket 12 can then be withdrawn from the support member 11. In case it is necessary to fasten the blanket 12 at the ends thereof to the support member 11, which can be effected, for example, by stitching or sewing with a thread, this fastening means initially be released or removed. Then a new blanket should simply be drawn over the support member 11 and fastened, if necessary. The reinstallation of the complete screen cylinder 10 is then effected in reverse sequence, the exchange being performable within an extremely brief period of time.

What is claimed:

1. In a dampening unit for offset printing machines having a dampening-medium tank, a rotating screen cylinder formed of a perforated support member covered by a blanket for conveying dampening medium supplied thereto from the tank, and a blow tube located adjacent the blanket and formed with nozzle openings for spraying the dampening medium by means of blowing air from the blanket onto a dampening-unit roller, the improvement therein which comprises means for freely rotatingly guiding the screen cylinder, and a driven dampening-medium conveying roller immersed in the dampening medium received in the tank and being in frictional engagement with the screen cylinder so as to feed the dampening medium from the tank to the blanket.

2. Dampening unit according to claim 1 wherein said guiding means define three mutually spaced, fixed lines disposed at the peripheral surface of the screen cylinder and along which the screen cylinder is guided in spatial position thereof so as to have only a single degree of freedom, namely rotation about the axis thereof.

3. Dampening unit according to claim 1 wherein said guiding means comprise said blow tube, and the screen cylinder frictionally engaging the dampening-medium conveying roller is guided on said blow tube.

4. Dampening unit according to claim 2 wherein said blow tube is disposed eccentrically to the rotary axis of the screen cylinder and wherein one of said fixed lines is located in the wall surface of said blow tube in vicinity of said nozzle openings formed therein, and another of said fixed lines is located in at least one spacer member extending from the wall surface of said blow tube at the opposite side thereof from said one of said fixed lines.

5. Dampening unit according to claim 1 including means for stripping dampening medium from said conveying roller, said stripping means being disposed along said conveying roller upstream of a line of frictional engagement of said conveying roller with the screen cylinder in direction of rotation of said conveying roller and being zonewise adjustable with respect to the peripheral surface of said conveying roller, and variable-speed drive means for said conveying roller.

6. Dampening unit according to claim 1 including an air supply tube for the blowing air having a smaller diameter than and being disposed within said blow tube, said air supply tube being formed with openings located offset in peripheral direction from the nozzle openings formed in said blow tube whereby air is supplied to said blow tube through said openings formed in said air supply tube, and said blow tube serves as an air storage chamber.

7. Dampening unit according to claim 1 wherein the nozzle openings formed in said blow tube are bores formed in the wall thereof, said bores having a diameter smaller than the thickness of the wall of said blow tube.

8. Dampening unit according to claim 1 including means for regulating the intensity of the blowing air.

9. Dampening unit according to claim 4 wherein said one spacer member is radially disposed at one end of said blow tube, and another spacer member is radially disposed at the other end of said blow tube.

10. Dampening unit according to claim 1 wherein at least a surface portion of the conveying roller is formed of hydrophilic material.

11. Dampening unit according to claim 1 wherein said conveying roller is covered with an hydrophilic fabric material.

12. In a dampening unit for offset printing machines having a dampening-medium tank, a rotating screen cylinder formed of a perforated support member covered by a blanket for conveying dampening medium supplied thereto from the tank, and a blow tube located adjacent the blanket and formed with nozzle openings for spraying the dampening medium by means of blowing air from the blanket onto a dampening-unit roller, the improvement therein which comprises a dampening-medium conveying roller immersed in the dampening medium received in the tank and being in frictional engagement with the screen cylinder so as to feed the dampening medium from the tank to the blanket, the tank forming part of a container surrounding the screen cylinder and said conveying roller and formed with a substantially horizontal opening extending along the length thereof for providing access by a jet of the dampening medium blown by the air to the dampening-unit roller, shutter means defining upper and lower limits of said substantially horizontal opening, the shutter means defining the upper limit being spaced slightly from the screen cylinder, and the shutter means defining the lower limit being spaced slightly from the dampening-unit roller, the latter being disposed within said substantially horizontal opening so as to leave a partial opening at the top thereof for discharge of air from said container.

* * * * *